US005527206A

United States Patent [19]

Sjolander et al.

[11] Patent Number: 5,527,206

[45] Date of Patent: Jun. 18, 1996

[54] HOLDER DEVICE

[75] Inventors: Robert Sjolander; Bo Sjolander, both of Oakville, Canada

[73] Assignee: CME Blasting & Mining Equipment Ltd., Oakville, Canada

[21] Appl. No.: 305,176

[22] Filed: Sep. 13, 1994

[30] Foreign Application Priority Data

Jan. 28, 1994 [SE] Sweden ..... 9400282

[51] Int. Cl.[6] ..... B24B 23/02

[52] U.S. Cl. ..... 451/342; 451/359

[58] Field of Search ..... 451/342, 359, 451/363, 548, 911; 403/225, 226; 279/904, 906

[56] References Cited

U.S. PATENT DOCUMENTS

| | | | |
|---|---|---|---|
| 2,051,954 | 8/1936 | Leland | 77/58 |
| 2,286,292 | 6/1942 | Mall | 451/342 |
| 2,633,008 | 3/1953 | Tocci-Guilbert | 451/342 |
| 2,656,190 | 10/1953 | Towle | 451/342 |
| 3,167,892 | 2/1965 | Anecki | 451/342 |
| 4,237,659 | 12/1980 | Welsch et al. | 451/342 |
| 4,986,704 | 1/1991 | Narushima et al. | 451/342 |
| 5,157,873 | 10/1992 | Rudolf et al. | 451/342 |

FOREIGN PATENT DOCUMENTS

| | | |
|---|---|---|
| 460584 | 10/1986 | Sweden . |
| 8604158-9 | 10/1986 | Sweden . |

*Primary Examiner*—Maurina T. Rachuba
*Attorney, Agent, or Firm*—Rolf Fasth

[57] ABSTRACT

A holder device for use in a motor driven grinding machine for grinding button bits. The grinding machine has an output shaft formed with an axially extending passageway for receiving a stem attached to and extending outwardly from a grinding cup. The shaft has interengaging drive means for driveably engaging the grinding cup to the free end of the shaft. An O-ring engages between the stem and the passageway for removably retaining the stem in the passageway.

7 Claims, 2 Drawing Sheets

HOLDER DEVICE

TECHNICAL FIELD

The present invention relates to a holder device to detachable hold a grinding cup driven by a grinding machine for grinding button bits, i.e. tungsten carbide cutting teeth of a drilling head.

BACKGROUND ART

Different grinding machines are known for the purpose mentioned above. In such grinding machines the grinding cup is conventionally held by a chuck for detachable mounting of tools. Because the grinding cup is rigidly retained within the chuck the vibrations generated by grinding operations are directly transferred to the grinding machine. Furthermore, special tools such as a chuck wrench are necessary to insert and to remove the grinding cup into and out of the chuck.

DISCLOSURE OF THE INVENTION

Objects of the present invention are, on the one hand to solve the problems mentioned above for holder devices known per se and on the other hand also to provide a holder means of minimum size enabling quick attachment and removal of a grinding cup.

This is solved in the illustrated embodiment of the invention by a holder means arranged on the output shaft of the motor unit and comprising a rotatable hollow elongate member at the free end of which attachment means are provided for securing a grinding cup therein so that the grinding cup is driven by the holder means. A stem attached to the grinding cup is inserted into a passageway or channel of the hollow elongate member and it is fixed therein by at least one elastic means.

In a preferred embodiment of the present invention, a damping element is arranged within the passageway of the hollow elongate member to bear against the end of the grinding cup stem inserted in the hollow elongate member. The damping element is preferably shaped as a tubular sleeve of an elastomeric material. The sleeve is contained within a cavity formed in the channel and spaced a predetermined distance from the free end surface of the hollow elongate member.

An elastic means is adapted for operative engagement between the stem and the channel for removably retaining the stem in the channel. In the preferred embodiment, the elastic means is an O-ring that engages in an annular groove formed on the stem and in an annular groove formed within the channel of the elongate member. An interengaging drive means for driving the grinding cup comprises a diametrically extending recess at the free end of the hollow elongate member co-operating with a cam means on the adjacent surface of the grinding cup.

The holder device of the present invention provides the following advantages compared to conventional types:

1. Elimination of vibrations normally generated and transferred to the grinding machine by grinding with grinding cups carried in a rigid manner by a conventional type chuck.
2. "Floating Chuck" mounting of the grinding cup flexibly carried in the holder device by the O ring(s).
3. Quick and simple changing of grinding cups without use of any locking tool.

4. Reduced sound level due to the elimination of vibrations which provides a highly improved environment for the operator.
5. Tiring impacts on the operator's hands and arms are substantially reduced due to the elimination of vibrations.
6. Further improvements established include:
   a) less maintenance of the grinding machine,
   b) increased life of the grinding cup,
   c) reduced grinding costs,
   d) improved grinding quality, i.e. the surface profile of the button bits is returned with an increased accuracy, generating a better finish without any grinding traces,
   e) extended time periods between regrinding of the button bits, which means higher rates of drilling production between the regrinding occasions, and
   f) lower drilling costs.

BRIEF DESCRIPTION OF THE DRAWINGS

The inventive holder device will now be described in more detail below as used together with a pneumatically driven grinding machine having a single air motor shown in the accompanying drawings, where.

DETAILED DESCRIPTION OF PREFERRED EMBODIMENTS

Figure 1:
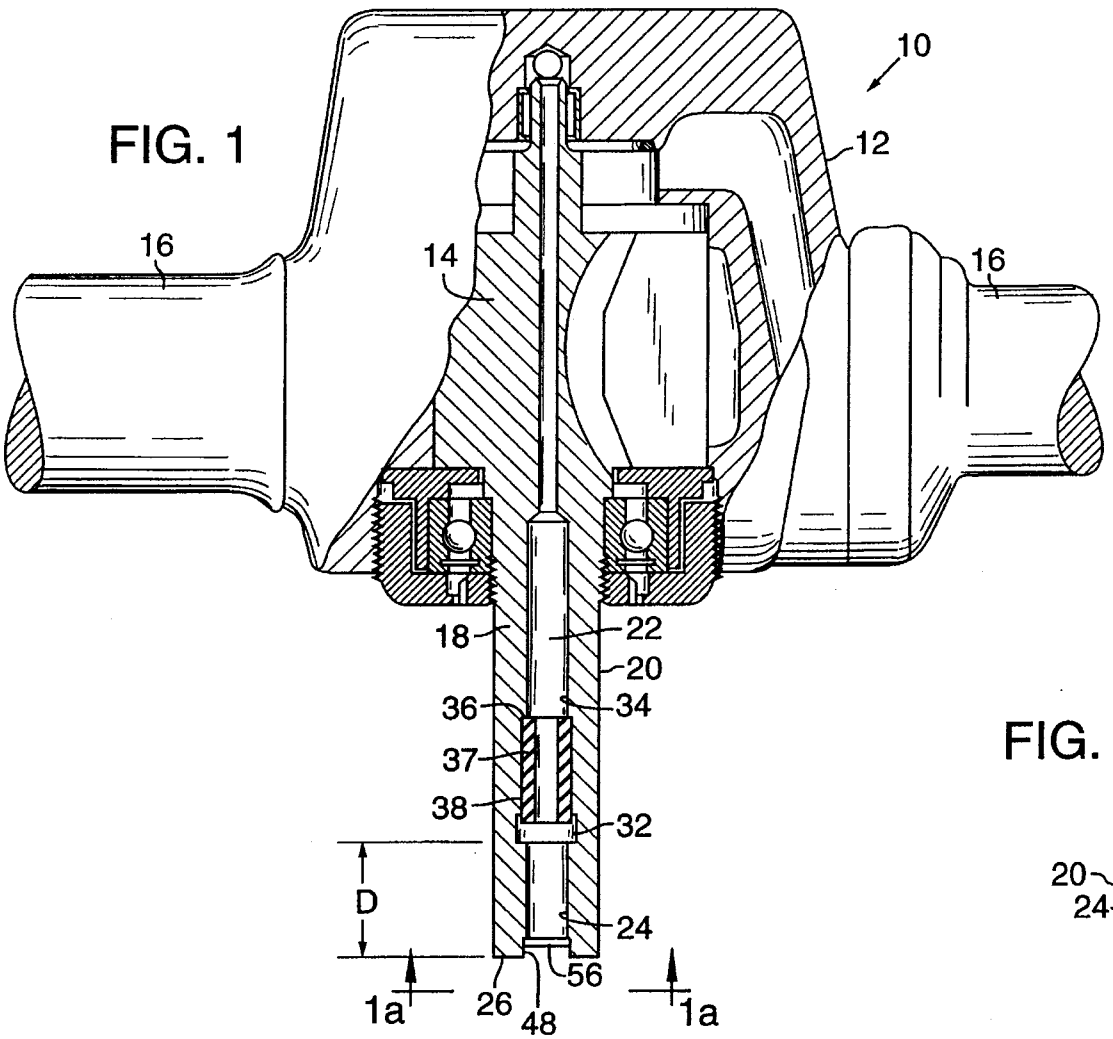
FIG. 1 is a side elevation partly in section of a grinding machine having a single air motor, the rotor of which is extended to form a holder device for a grinding cup according to the invention.

The illustrated embodiment of the invention comprises a grinding machine 10 which includes a motor housing or casing 12 within which is suitably supported a rotary motor, the illustrated motor being a pneumatically driven motor 14 adapted to be supplied with compressed air from a suitable source (not shown). The dimensions of the casing 12 are such that the grinding machine may be easily handled manually. For the latter purpose, the casing is provided with handles 16 projecting diametrically oppositely outwardly from the casing. The motor 14 drives an output shaft 18. Suitably connected to the output shaft 18 by any conventional means is a holder device 20. In the illustrated embodiment, the holder device 20 is an integral extension of the shaft 18 which constitutes a rotatable elongate member. The shaft 18 and holder device 20 are provided with a stepped coaxial passageway or opening 22 extending the length thereof and through which coolant fluid may be directed to a grinding cup 30 supported thereon, the grinding cup being shown in FIG. 2 and described in detail below. An outer portion 24 of the opening 22, extending inwardly from a free end 26 of the holder device, is sized snugly, but slidably, to receive a stem 28 of the grinding cup 30 in which is secured an abrasive element 31 for grinding button bits. Elastic means are provided for operative engagement between the stem 28 and the wall of the passageway 22 for removably retaining the stem 28 in the passageway. Formed in the wall of the opening portion 24 a predetermined distance D from the free end 26 is an annular recess 32, the purpose of which will be described below. The opening portion 24 extends inwardly beyond the recess 32 a further predetermined distance to form with a further extending opening portion 34 of smaller diameter, an annular shoulder 36 and to define between the shoulder 36 and the recess 32 a cylindrical cavity 37. Fitted within the cavity 37 abutting the shoulder 36 and extending slightly into the recess 32 is a damping element comprising an elastic sleeve 38 formed of rubber or other suitable elastomeric material.

Figure 1A:
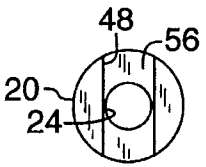
FIG. 1*a* is a bottom view of the rotor seen in the direction of the line A—A in FIG. 1.
Figure 2:
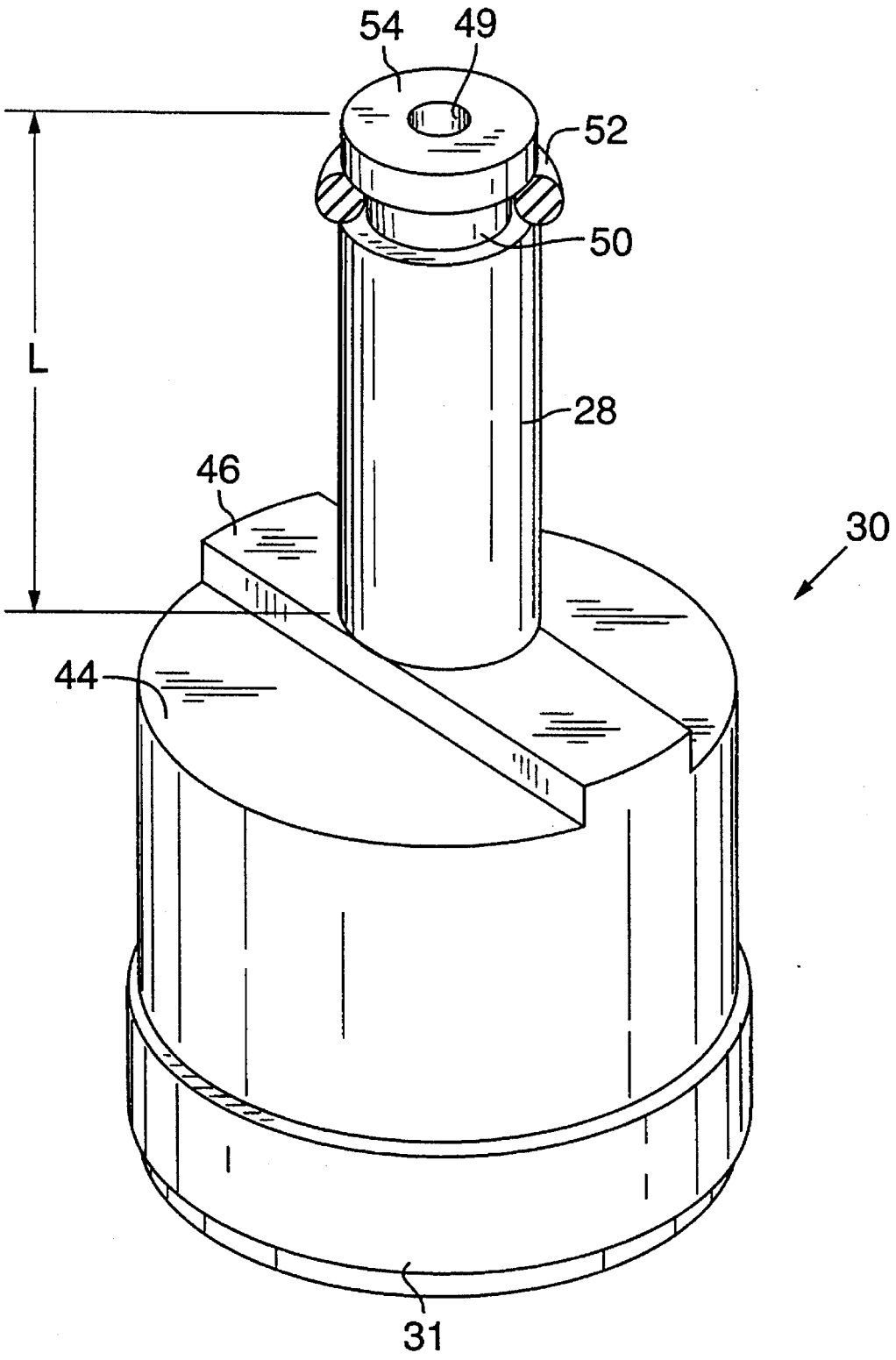
FIG. 2 is an enlarged perspective view of a grinding cup to be retained by the holder device according to the invention.

Referring now more particularly to FIG. 2, the grinding cup 30 is formed with a bottom surface 44 from which projects a diametrically extending cam 46. The stem 28 extends a predetermined distance L from the cup bottom surface 44 and is provided with an axially extending opening 49 which opens into the cup portion supporting the abrasive element 31. Formed in the stem 28 is an annular recess 50 in which an O-ring 52 is snugly received. The cup 30 is adapted to be mounted on the holding device 20 by inserting the stem 28 into the opening portion 24 from the free end 26 of the holding device 20. The length L of the stem and the dimensions of the holding device are such that when the cup 30 is fully mounted in the holding device, a free end 54 of the stem compressively engages the end of the sleeve 38 with the O-ring 52 received within the recesses 32 and 50 and with the cam 46 engaged in a slot 48 (FIG. 1*a*) formed in the free end 26 of the shaft 18. Suitable interengaging means other than the slot 48 and cam 46 will be apparent to those of ordinary skill in the art. Thus the distance D between the free end 26 of the holding device 20 and the top of the recess 32 is slightly less than the length L of the projection of the stem from the cup bottom surface 44. With the cup so mounted, the vibrations generated in the grinding cup 30 during the grinding operation are substantially absorbed by the resilient sleeve 38 and are thus not transmitted to the handles 16, reducing the fatigue of the operator of the machine and providing the other advantages described herein before. The use of the O-ring 52 to secure the cup 30 in the holder device permits easy mounting and removal of the grinding cup 30 from the holding device 20. As will be apparent, it is desirable that the recess 50 in the cup stem 28 be slightly deeper than the holder recess 32 whereby the O-ring 52 will remain seated on the stem as it is withdrawn from the holder device 20.

The O-ring(s) therefore have three functions:

(a) to securely hold the grinding cup in the holder device;

(b) to seal the flow of coolant moving through the holder device and the stem of the grinding cup to the grinding surface; and (c) the tolerances between the holder recess 32 and stem 28 are such that in the preferred embodiment there is slight radial movement of the stem ("floating chuck") which further permits the absorption of vibrations and resonance generated during grinding. The O-ring(s) act as an elastic means for centering the stem of the grinding cup in the opening of the holder device. In the case of a single O-ring it acts as a radial pivot point for the radial movement that takes place during grinding particularly when using semi-automatic grinding apparatus as described for example in U.S. Pat. No. 5,193,312 and Canadian Patent 1,325,108.

Additions and modifications to the device as described above can be made. For example, it will be apparent that two or more O-rings could be mounted on the shaft 28 to engage in cooperative recesses formed in the wall of the shaft opening 24 more securely and more stably to fix the grinding cup to the grinding machine. In place of the elastomeric sleeve 38 or in supplement thereto a coil spring could be utilized. Also, a pad 56 of rubber or the like could be positioned in the slot 48 so as to be engaged and compressed by the cam 46. The shaft opening 22 and stem opening 49 permit coolant air to be passed to the grinding element 31 to extract heat therefrom. The holder device of the present invention can be used with the hand held grinding machine illustrated in FIG. 1 or with semi automatic grinding apparatus where the grinding head is carried on a robot arm or similar device.

Having illustrated and described a preferred embodiment of the invention and certain possible modifications thereto, it should be apparent to those of ordinary skill in the art that the invention permits of further modification in arrangement and detail. I claim all such modifications coming within the scope of the appended claims.

We claim:

1. A holder device for connection to a motor driven grinding machine for grinding button bits, said machine having an output shaft, comprising:

a rotatable elongate member having one end adapted to be secured to said output shaft of said grinding machine and an opposite free end adapted to extend outwardly away from said grinding machine, said elongate member having a passageway formed therein;

a grinding cup;

interengaging drive means on said cup and said elongate member for driveably engaging said grinding cup to said free end of said elongate member;

a stem attached to said grinding cup and extending outwardly therefrom, said stem being adapted to be received in said passageway, said stem having a free end surface remote from said grinding cup;

elastic means for operative engagement between said stem and said passageway for removably retaining said stem in said passageway and;

a damping element disposed within said passageway, said damping element bearing against said free end surface of said stem when said stem is mounted in said passageway.

2. A holder device according to claim 1 wherein said damping element is a tubular sleeve made from an elastomeric material.

3. A holder device according to claim 1 wherein said damping element is made of rubber.

4. A holder device according to claim 1 wherein said elastic means is a ring-shaped element adapted to be mounted on said stem.

5. A holder device according claim 4 wherein said elongate member has a groove formed in the wall of said passageway for receiving said ring-shaped element.

6. A holder device according to claim 1 wherein said drive means comprises a diametrically extending recess formed at said free end of said elongate member and said grinding cup has a cam portion adapted to operatively engage with said recess when said stem is mounted in said passageway.

7. A holder device for connection to a motor driven grinding machine for grinding button bits, said machine having an output shaft, comprising:

a rotatable elongate member having one end adapted to be secured to said output shaft of said grinding machine and an opposite free end adapted to extend outwardly away from said grinding machine, said elongate member having an axial passageway extending inwardly from said free end and an annular cavity formed in the wall of said passageway, said cavity being spaced a predetermined distance from said free end of said elongate member, said free end having a diametrically extending recess formed therein, said elongate member having an annular groove formed within said passageway between said free end and said cavity;

a grinding cup having a cam portion formed at a bottom thereof, the cam portion being adapted to operatively engage in said recess of said free end of said elongate member;

a stem having one end attached to said grinding cup and an opposite free end having an end surface, said stem having a length slightly greater than said predetermined distance, said stem extending outwardly from said grinding cup and being adapted to be mounted in said passageway, said stem having an annular groove formed therein;

an O-ring adapted to be mounted in said groove of said stem and to engage in said groove of said elongate member for removably retaining said stem in said passageway; and an elastic tubular sleeve disposed within said cavity so that said tubular sleeve bears against said end surface of said free end of said stem when said stem is mounted in said passageway.

* * * * *